United States Patent [19]

Erickson et al.

[11] 4,137,433

[45] Jan. 30, 1979

[54] BOLTED PRESSURE SWITCH WITH SIDE OPERATOR MECHANISM AND DOOR ASSEMBLY INTERLOCK

[75] Inventors: James A. Erickson; John W. Erickson, both of Crystal Lake, Ill.

[73] Assignee: Boltswitch, Inc., Crystal Lake, Ill.

[21] Appl. No.: 805,597

[22] Filed: Jun. 10, 1977

[51] Int. Cl.[2] ..... H01H 9/20; H01H 3/00

[52] U.S. Cl. ..... 200/50 A; 200/153 G; 200/153 V

[58] Field of Search ..... 200/50 A, 153 SC, 153 V, 200/153 G

[56] References Cited

U.S. PATENT DOCUMENTS

| | | | |
|---|---|---|---|
| 2,943,163 | 6/1960 | Hay | 200/153 SC X |
| 3,084,238 | 4/1963 | Baskerville | 200/153 SC X |
| 3,522,401 | 8/1970 | Stene | 200/153 V X |
| 3,876,847 | 4/1975 | Dykes et al. | 200/153 SC |

*Primary Examiner*—James R. Scott

*Attorney, Agent, or Firm*—Kinzer, Plyer, Dorn & McEachran

[57] ABSTRACT

An operating mechanism for opening and closing the movable contacts of a load break pressure contact switch which is operable from a side of a switch enclosure and has an optional door safety interlock. The operating mechanism comprises a main shaft with a handle attached thereto for rotating the shaft in opposite directions between switch-open and switch-closed positions. An operating lever which is connected to the movable switch contacts is driven by an overcenter toggle spring means which is operated by the main shaft through a lost motion connection mechanism. An optional interlock is provided for the switch enclosure access door and includes a latch to hold the access door closed when the switch contacts are in their closed position and a mechanism to prevent movement of the switch contacts to their closed position when the access door is open. The interlock is operatively actuatable through cam surfaces and stop surfaces on the lost motion connection mechanism. An override for the door latch allows the access door to be opened while the switch contacts remain closed.

8 Claims, 7 Drawing Figures

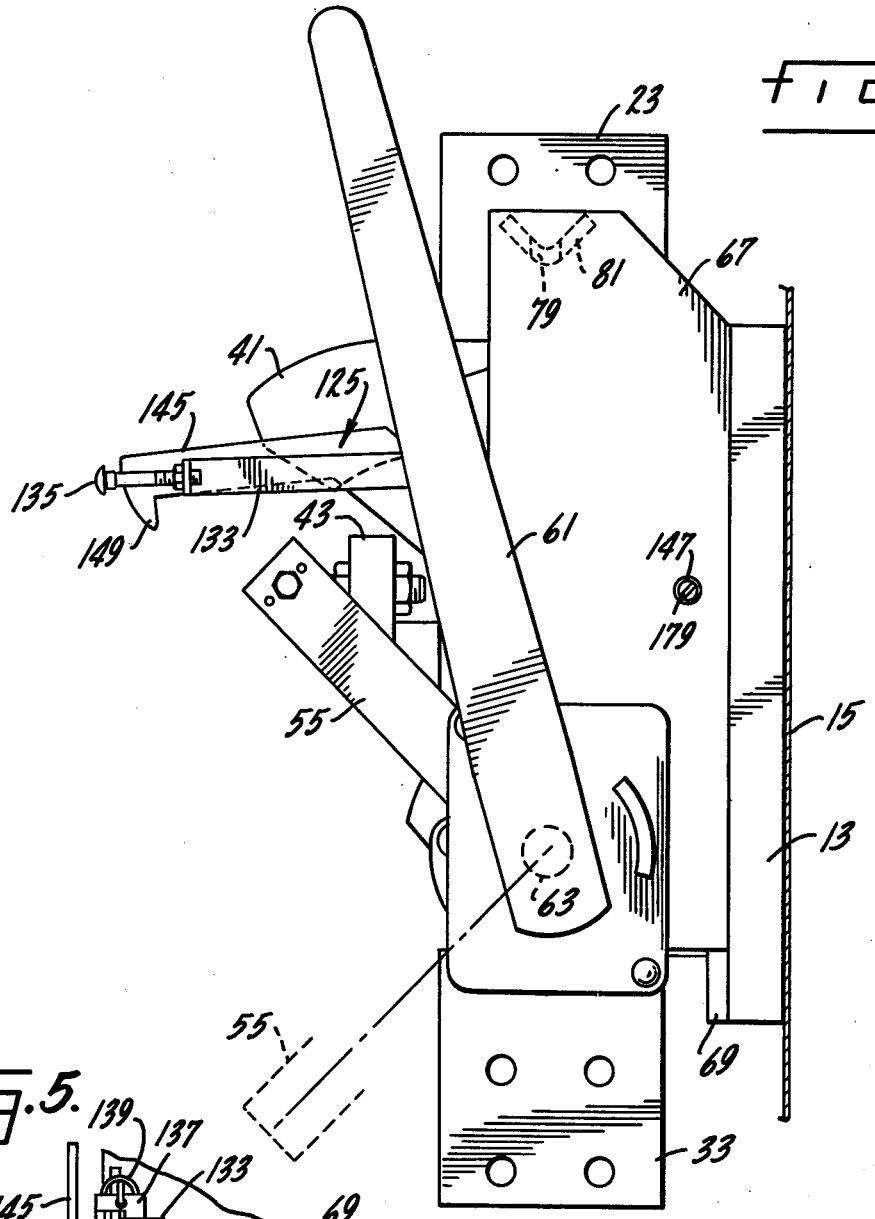
fig.2.
fig.5.
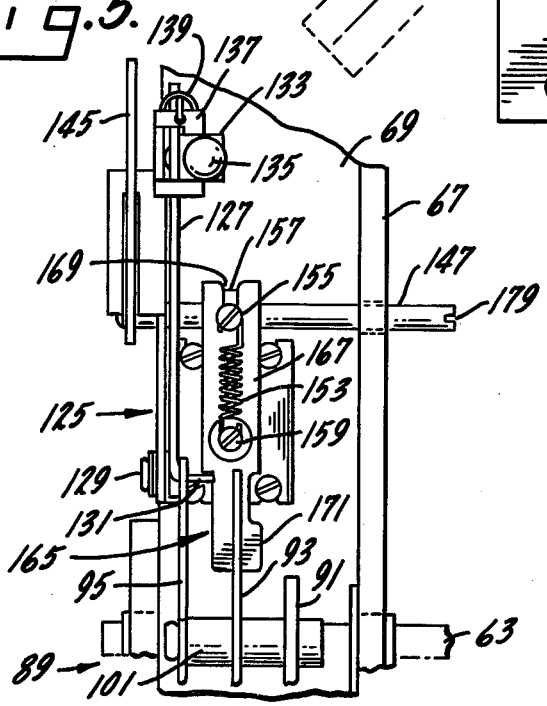
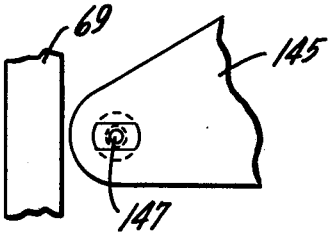
fig.6.

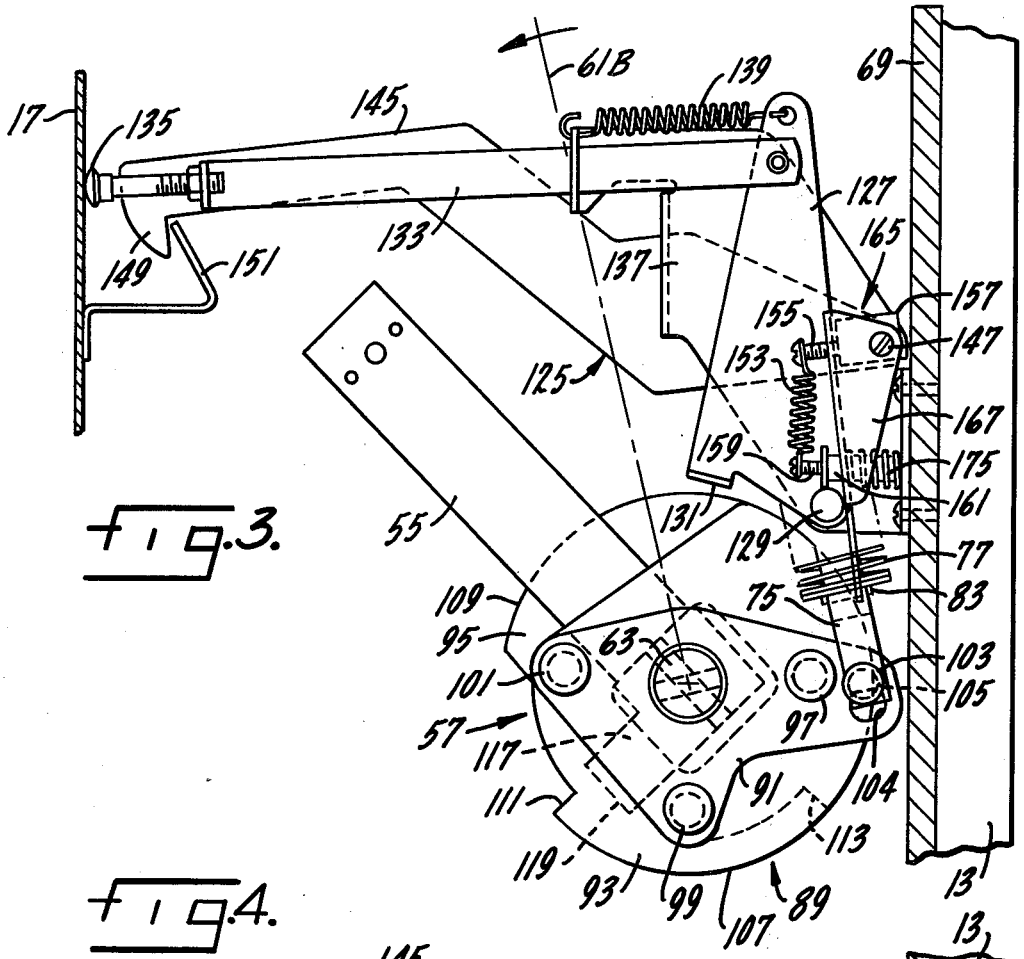
fig.3.
fig.4.
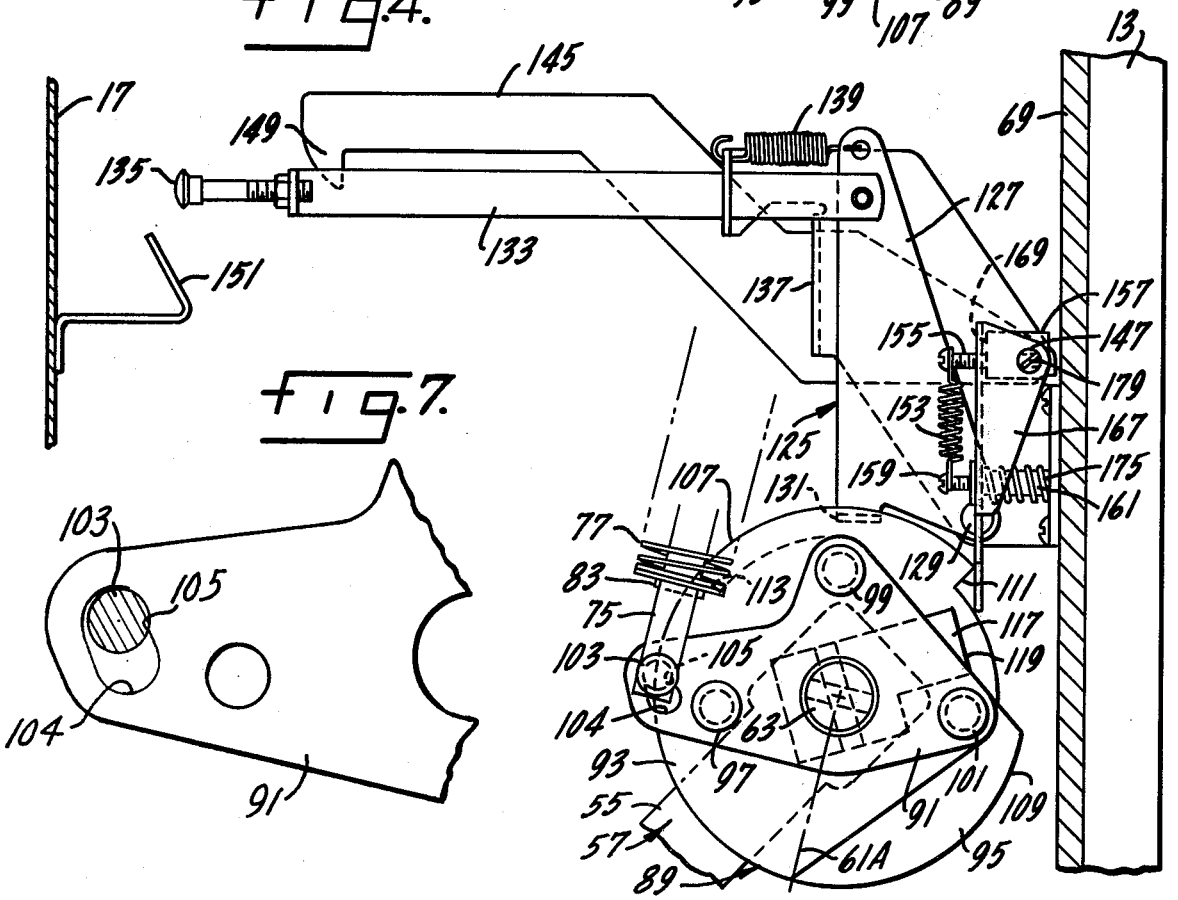
fig.7.

BOLTED PRESSURE SWITCH WITH SIDE OPERATOR MECHANISM AND DOOR ASSEMBLY INTERLOCK

BACKGROUND OF THE INVENTION

This invention relates to a new and improved switch operating mechanism particularly intended for use with loadbreak pressure contact switches, adapted for manual operation from a side of the switch enclosure and having an optional enclosure door safety interlock.

Fused load break pressure contact switches are frequently used as service entrance equipment and in other relatively high current applications. Typically, switches of this type may be used in multipole switching applications requiring interruption under load of currents of the order of 400 to 6,000 amperes. In such switches, it is critically important that the contacts open and close rapidly to minimize arcing and thereby avoid pitting and deterioration of the contact members. Most switches of this kind are provided with a latching mechanism for each pole of the switch to secure the contacts in closed position and prevent any accidental opening of the switch due to external shocks or other factors. The switch blades are relatively heavy and mechanical forces involved in opening and closing of the switch may be substantial.

Rapid opening and closing of the switch contacts is accomplished by overcenter toggle spring mechanisms which accelerate the speed of opening and closing of the switch contacts. Spring mechanisms of this type have used lost motion mechanisms operatively connected between the operator's handle and the switch contacts. Mechanisms of this type provide manual opening of the switch contacts to a point at which disengagement is almost achieved, followed by a rapid spring actuated movement of the switch blades clear of the fixed switch contacts.

Many previously known switch operating mechanisms of this general type have been designed for operation from the front of the switch enclosure. Further, interlock mechanisms to prevent opening of the switch enclosure when the switch contacts are closed and closing of the switch contacts when the enclosure access door is open have been complicated and expensive.

SUMMARY OF THE INVENTION

Thus, an object of this invention is to provide a new and improved switch operating mechanism for opening and closing the movable contacts of a load break pressure contact switch, which mechanism is located on a side of the switch enclosure.

Another object of this invention is to provide a new and improved switch operating mechanism for opening and closing the movable contacts of a load break pressure contact switch, which mechanism may be interconnected with the access door of the switch enclosure to prevent opening of the access door while the switch contacts are closed and also to prevent closing of the switch contacts while the access door is open.

Another object of this invention is to provide a new and improved switch operating mechanism for opening and closing the movable contacts of a load break pressure contact switch in which an interlock mechanism for the door is actuated by a lost motion connection between the operator's handle and the operating lever for the movable switch contacts.

Another object of this invention is to provide a switch of the type described in which the switch contacts and prevented from being moved to their closed position while the switch enclosure access door is open by engagement of a spring biased stop means with a cam shoulder formed as part of a lost motion connection between the operator's handle and the operating lever for the switch contacts.

Accordingly, the invention relates to a switch operating mechanism for opening and closing the movable contacts of a load break bolted pressure contact switch located in an enclosure having an access door. The mechanism includes a main shaft and an operator's handle attached to the main shaft for rotating it in opposite directions between switch-open and switch-closed positions. An operating lever formed of an insulating material is rotatably mounted on the shaft and is mechanically connected to the movable switch contacts. An overcenter toggle spring means for driving the operating lever to its contact open and contact closed positions is formed as part of the mechanism. A lost motion connection is located between the main shaft, the operating lever and the overcenter toggle spring mechanism. The overcenter toggle spring means is attached to the lost motion connection by a pin located in an elongated slot. The elongated slot has a detent projection dividing the slot into two portions. The detent retains the pin in one portion of the slot until overridden to allow the pin to move to the other portion of the slot as the toggle pin reaches its fully compressed condition. The lost motion connector is constructed so that initial rotation of the main shaft compresses the overcenter spring and moves it to its center toggle position. During movement from the switch-closed to the switch-open position, the operating lever is rotated by the lost motion connection before the overcenter spring mechanism is moved past its center toggle position. During movement from the switch-open to the switch-closed positions, the overcenter spring mechanism is moved past its center toggle position by the lost motion mechanism before the operating lever is rotated. An interlock is provided for the housing access door and includes means to latch the access door closed when the switch contacts are in their closed position. The interlock also includes means to prevent movement of the switch contacts to their closed position when the enclosure access door is open. The interlock means is operatively actuatable through engagement with cam surfaces and stop surfaces on the lost motion connection mechanism.

BRIEF DESCRIPTION OF THE DRAWINGS

FIG. 2 is a side elevational view of the switch mechanism of FIG. 1, with some parts omitted for clarity of illustration and with the door interlock system illustrated;

FIG. 3 is a partial side elevational view of the switch operating mechanism of FIG. 2 with the access door closed and the switch contacts in their closed postion, with some parts omitted for clarity of illustration;

FIG. 4 is a side elevational view, similar to that of FIG. 3, showing the access door in its open position and the switch contacts in their open position;

FIG. 5 is a partial front elevational view of the door interlock mechanism; and

FIG. 6 is an enlarged partial side elevational view of a portion of the mechanism shown in FIG. 5.

FIG. 7 is an enlarged, partial view of the mechanism of FIG. 4 with parts omitted for clarity of illustration.

DESCRIPTION OF THE PREFERRED EMBODIMENT

Figure 1:
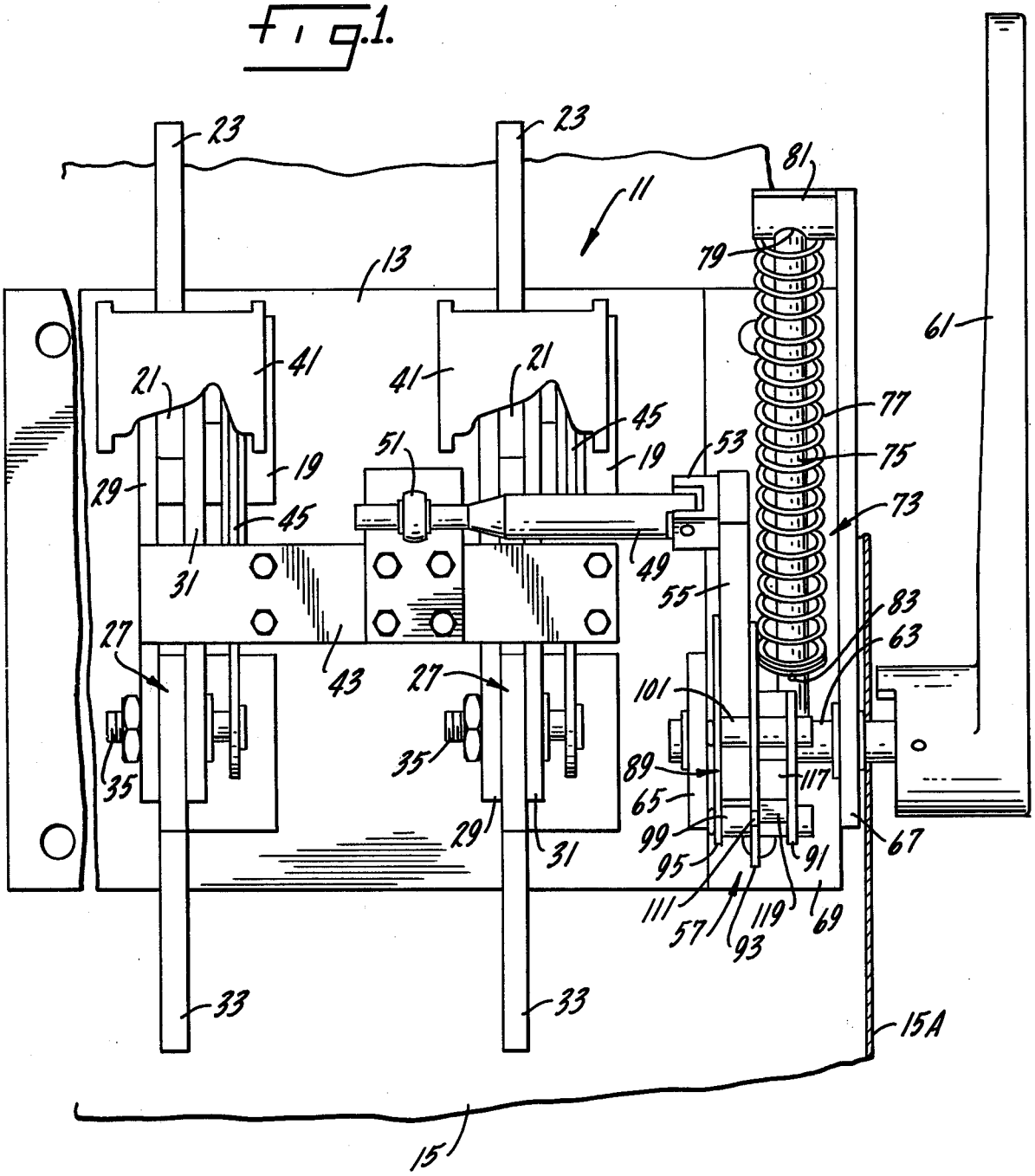
FIG. 1 is a partial front elevational view illustrating a manually actuated, side operated, switch operating mechanism constructed in accordance with the teachings of the invention for operating a switch of a known construction, with some parts omitted and broken away for clarity of illustration.

FIG. 1 of the drawings illustrates a load break pressure contact switch 11, of known construction, in its closed condition. The switch illustrated is an unfused, two-pole direct current switch of 1800 to 3600 amperes capacity which could be used for an overhead crane. Switch 11 includes a base member 13 fabricated from a suitable insulating material. The base member 13 is positioned inside a metal closure 15 having a hinged front access door 17 (FIGS. 3 and 4). At the top of the base 13, there are mounted two spaced fixed contact members 19 (FIG. 1). Each of the contact members is provided with an outwardly projecting contact blade 21 and a terminal lug 23.

Each of the fixed contact members 19 is one element of a pole of the switch 11. Each fixed contact is engageable by a movable contact 27. Each of the movable contacts of the switch comprise a pair of contact blades 29 and 31. Each pair of contact blades 29 and 31 is pivotally mounted on a terminal lug 33 by means of a suitable pivot member 35 including a bolt and nut. An arc chute 41 is mounted on each fixed contact. A suitable arc chute is shown in U.S. Pat. No. 3,441,699, but the invention should not be limited to the use of the particular arc chute shown in that patent since that arc chute is merely illustrative of one of a number of different forms of arc chutes which may be used.

Switch 11 further includes an actuating bar 43 that extends transversely of the switch and is connected to each of the movable contacts 27 by means of a connecting linkage 45, so that arcuate movement of the actuating bar 43 with respect to the pivotal connections of the movable contacts 27 drives the movable contacts of the switch to move pivotally into and out of engagement with the fixed contacts 19.

Switch 11, as thus far described, corresponds generally to the construction of the load-break, pressure contact switch described and claimed in U.S. Pat. No. 3,213,247. The present invention is not directed to the switch structure per se, and should not be construed as limited to use with the particular load-break switch structure of U.S. Pat. No. 3,213,247 or with the switch structure shown herein, both of which are merely illustrative of several of a number of different forms of switches in which the invention may be incorporated.

The actuating bar 43 of the switch 11 is connected to operating rod 49 by means of a socket type universal connector 51. A connector of this type is marketed under the designation "ALINABAL". The opposite end of the operating rod 49 is pivotally connected to a clevis 53 mounted on one side of an operating lever 55 at the free end thereof. The operating lever 55 is formed of a suitable insulating material and is part of a switch operating mechanism 57.

The present invention pertains to the switch operating mechanism 57 and also to an optional door interlock, which is described hereinafter. It is particularly concerned with a switch operating mechanism that can be located on a side of a switch enclosure for the safety of the operator.

An operating handle 61 located on the outside of the switch enclosure 15 is fastened to a main shaft 63 which extends through a side wall 15A of the enclosure 15. The main shaft 63 is journalled in brackets 65 and 67 which are mounted on an extension 69 of the base member 13. Also mounted on the bracket 67 is an overcenter spring mechanism 73 that is utilized to actuate the switch 11 in a quick make, quick break operation as is described more fully hereinafter. The overcenter spring mechanism 73 also biases the switch operating mechanism either to the switch-closed position shown in FIGS. 2 and 3, or to the open-switch position of FIG. 4.

The overcenter spring mechanism 73 is of the toggle type and includes a drive rod 75 extending through a coil spring 77. The upper end of the drive rod is slidably and pivotally mounted in an opening 79 formed in the apex of an inverted V-shaped support 81 which is fastened to the upper end of the bracket 67. The spring 77 is captured between the V-shaped support 81 and a stop pin and washer 83 positioned near the lower end of the drive rod. The lower end of the drive rod is pivotally connected to a lost motion mechanism 89 mounted on the main shaft 63.

The lost motion mechanism 89 is shown most clearly in FIG. 1, 3 and 4 and includes follower plates 91, 93 and 95 spaced along and rotatably mounted on the main shaft 63. The follower plates are connected by pins 97, 99 and 101 located in an arc around the main shaft 63. As seen in FIG. 3, the arcuate distance from pin 97 to 99 in a clockwise direction is approximately 94° while the arcuate distance from pin 99 to 101, also in a clockwise direction, is approximately 96°. The drive rod 75 of the overcenter spring mechanism 73 is connected at its lower end to the follower plate 91 by a pivot pin 103 which fits in an elongated slot 104 formed in the follower plate. The slot 104 is irregular in shape and includes a peak-like projection 105 on the inner wall thereof which functions as a detent for the pivot pin 103. When positioned at the top of the elongated slot 104 on one side of the detent peak 105, as viewed in FIG. 3, the axis of the pivot pin 103 will be located an arcuate distance of approximately 90° from the axis of the follower plate pin 99.

Follower plates 93 and 95 have partial circular peripheral edges 107 and 109, respectively, with each edge ending in a radially extending shoulder 111 and 113, respectively. When the lost motion mechanism is assembled, the shoulder 111 on follower plate 93 is positioned approximately 96° forward, in a clockwise direction as viewed in FIG. 3, of the shoulder 113 on the follower plate 95. Also, the shoulder 111 on follower plate 93 trails the connector pin 101, in a counterclockwise direction, as viewed in FIG. 3, by approximately 50°. The shoulder 113 on follower plate 95, as viewed in FIG. 3, trails the connector pin 99 in a counterclockwise direction by approximately 50°. The circular peripheral edges and the radial shoulders of the follower plates cooperate with the door interlock as described hereinafter.

A crank 17 affixed to the main shaft 63 is positioned between follower plates 91 and 93 of the lost motion mechanism (FIGS. 1, 3 and 4). The crank includes an outer portion 119 (FIGS. 3 and 4) of reduced width which extends radially between the connector pins 99 and 101. As shown in FIGS. 1, 3 and 4, the switch operating lever 55 is located between the follower plates 93 and 95 and extends between pins 97 and 101. It should be noted that the width of the switch operating lever 55 is much less than the distance between the pins 97 and 101.

An interlock mechanism 125 for the access door 17 of the metal enclosure 15 containing the switch 11 is shown in FIGS. 2 through 6 of the drawings. The interlock mechanism includes an elongated, somewhat triangular shaped stop member 127 pivoted at one corner on a shaft 129 (FIGS. 3-5). A laterally extending stop portion 131 is located at another corner of the triangular stop member. An elongated door contact arm 133 is pivotally connected at one end thereof to the triangular shaped door stop member near the upper end of the door stop member as viewed in FIGS. 3 and 4. A door bumper 135 is attached to the free end of the door contact arm 133. The door contact arm is supported by a bracket 137 mounted on the base member 69. A coil spring 139 connects the bracket 137 to the upper end of the triangular shaped stop member 127, thereby biasing the stop portion 131 towards the circular peripheral edge 109 and radial shoulder 113 of the follower plate 95 of the lost motion connection 89.

A door hook member 145 is fixed to a horizontally extending shaft 147 at one end thereof. Shaft 147 is supported on the brackets 67 and 137. The opposite end of the member 145 has a hook portion 149 which engages a latch 151 fastened to the inner surface of enclosure door 17 (FIG. 3).

The shaft 147 is biased for rotation in a counterclockwise direction, from the position of FIG. 4 toward the position shown in FIG. 3, by a coil spring 153. One end of the coil spring attaches to a screw 155 fastened in a block 157 which is affixed to the shaft 147. The opposite end of the spring 153 connects to a screw 159 extending into a post 161 mounted on the fixed bracket 137.

Pivotally mounted on the shaft 147 is a trigger mechanism 165 which resists the biasing action of the coil spring 153 and thus functions to retain the hook 145 in its elevated position and out of engagement with the door latch 151. The trigger device 165 includes a U-shaped member 167, which is pivotally mounted on the shaft 147, straddling the block 157. An elongated slot 169 extending from the upper edge of the front or face element 171 of the U-shaped member 167 receives the screw 155. An opening in the lower portion of the face 171 of the U-shaped member 167 enables that member to slide over the post 161 (FIGS. 3–5). A compression spring 175 fits over the post 161 and engages the inside of the face 171 of the U-shaped member 167 to bias it away from the base member 69. The biasing action of the spring 175 maintains the base of the elongated slot 169 of the trigger mechanism 165 in engagement with the screw 155 and overcomes the biasing effect of the spring 153; the compression spring 175 exerts a greater force than the coil spring 153. Thus, when the trigger mechanism 165 is in its fully extended position, as shown in FIG. 4, under the influence of the spring 175, the door hook 145 is held in its elevated position out of engagement with the door latch 151. Engagement of the circular peripheral edge 107 of the follower plate 93 with the front of the face 171 of the U-shaped member 167, as shown in FIGS. 3 and 5, moves the trigger mechanism against the spring 175 and allows the spring 153 to rotate the shaft 147 and move the hook 145 to its lowered door latching position, FIG. 3.

As is shown most clearly in FIGS. 2 and 5, the shaft 147 extends laterally through the bracket 69 and, although not shown in the drawings, the shaft also extends through the side wall 15A of the switch enclosure 15. A slot 179 is formed in the end of the shaft 147 and is adapted to receive a screwdriver. This permits the shaft to be operated from outside the switch enclosure. Thus, the hook mechanism 145 can be released by a qualified person and the access door 17 can be opened while the switch contacts are in their closed position.

In considering the operation of the switch mechanism, it may be assumed that the switch 11 is open as shown in FIG. 4 of the drawings. Under these circumstances, the operating handle 61 is in the position indicated by the dashed line 61A which depicts the center line of the handle. In order to close the switch, the operator must first close the hinged access door 17 to the switch enclosure 15. The engagement of the door 17 with the bumper 135 on the door contact arm 133 moves the arm to the right to the position shown in FIG. 3 of the drawings and rotates the triangular shaped stop member 127 in a clockwise direction, as viewed in FIG. 4, about pivot 129. This action lifts the laterally extending stop portion 131 out of the path of travel of the radial shoulder 113 on the follower plate 95. The door is thus closed and can be latched closed by a separate latch, not shown, but is not yet interlocked with the switch. That is, the hook 145 remains in its elevated position (FIG. 4) due to the resisting pressure of the trigger mechanism 165 which overcomes the biasing force of the spring 153 and thus prevents the shaft 147 from rotating in a counterclockwise direction from the position shown in FIG. 4 to that of FIG. 3.

The operator may then rotate the handle 61 in a clockwise direction as viewed in FIGS. 3 and 4. At the outset, the resulting clockwise rotation of the shaft 63 causes only rotational movement of the crank arm 117, which is securely affixed to the shaft. After some rotation of the operating handle 61, the outer portion 119 of the crank arm 117 engages connecting pin 101 and commences clockwise rotation of the lost motion connection 89, including follower plates 91, 93 and 95. Clockwise rotation of the lost motion connection 89 brings the circular peripheral edge 107 of the follower plate 93 into engagement with the lower extension of the U-shaped member 167, pivoting the trigger mechanism 165 against the force of spring 175. Pivotal movement of the member 167 moves the base of the elongated slot 169 in the face 171 of the member 167 out of engagement with the screw 155. The force exerted by the spring 153 rotates the screw 155, the block 157 and the shaft 147 in a counterclockwise direction from the positions of FIG. 4, bringing the hook portion 149 of member 145 into locking engagement with the door latch 151 as shown in FIG. 3. It should be noted that the latching of the door takes place before the switch contacts are closed.

Continued rotation of the operating handle 61 in a clockwise direction toward the position 61B (FIG. 3) causes crank arm 117, through its contact with connecting pin 101, to move the lost motion connection 89 through a sufficient arcuate distance that the connecting pin 101 engages the switch operating lever 55. During the rotation of the operating handle 61, the overcenter spring mechanism drive rod 75 is being moved towards its center toggle position. Although the connection between the drive rod 75 and the follower plate 91 of the lost motion connection 89 is an elongated slot, the follower plate 91 immediately moves the drive rod 75 as it commences movement because the pivot pin 103 is engaged by the detent peak 105. As the drive rod approaches its center toggle position, the increased resistance due to compression of the spring 77 causes the pivot pin 103 to jump over the detent peak 105 thus providing additional lost motion before the connecting pin 101 engages the switch operating lever 55.

The connecting pins 101 and 103 are spaced so that the drive rod 75 of the overcenter spring mechanism passes its center toggle position just before the connecting pin 101 engages the switch operating lever 55. Thus, manual rotation of the operating lever 61 first compresses the coil spring 77, after which expansion of the spring 77 rapidly closes the movable contact blades 29 and 31 into engagement with the fixed contact blades 21 (FIG. 1). Expansion of the spring 77 drives the drive rod 75 to the position shown in FIG. 3. The movement of the drive rod rotates the switch operating lever 55 to the position shown in FIG. 3, which brings about the complete closing of the switch contacts 19 and 27.

Once the switch is completely closed, the interlock mechanism is in the position shown in FIG. 3. The door is latched by engagement of the hook 149 with the door latch 151. If it is necessary for authorized repair personnel to open the access door 17, this can be accomplished by the insertion of a screwdriver in the slot 179 of the shaft 147 (the slot can be masked to inhibit unauthorized tampering). Rotation of the shaft 147 in a clockwise direction, as shown in FIG. 3, will lift the hook 145 against the compression of the spring 153. The trigger mechanism 165 does not interfere with clockwise rotation of the shaft 147, since its only contact with the shaft is through the engagement of the slot 169 of the trigger face 171 with the screw 155; thus, it only resists counterclockwise latching movement of the hook and not unlatching movement.

The switch 11 is opened by rotating the handle 61 in a counterclockwise direction from the position indicated by the dashed line 61B in FIG. 3. Upon initial rotation of the handle 61, only the shaft 63 and the crank arm 117 rigidly attached thereto rotate with the handle. After an initial period of rotation of the operating handle 61, the outer portion 119 of the crank arm 117 engages connecting pin 99 and commences counterclockwise rotation of the lost motion connection 89. Rotation of the lost motion connection causes movement of the drive rod 75 and compression of the spring 77.

Continued rotation of the operating handle 61 in a counterclockwise direction causes the crank arm 117, through its contact with connecting pin 99, to move the lost motion connection 89 through a sufficient arcuate distance that the connecting pin 97 engages the switch operating lever 55. During this period of rotation of the operating handle 61, the overcenter spring mechanism drive rod 75 is being moved toward its center toggle position. As the drive rod approaches its center toggle position, the increased resistance due to compression of the spring 77 causes the pivot pin 103 to jump over the detent peak 105 thus providing additional lost motion before the connecting pin 97 engages the switch operating lever 55. The connecting pins of the lost motion connection are spaced so that the connecting pin 97 engages the switch operating lever 55 before the drive rod 75 of the overcenter spring mechanism reaches its center toggle position. Thus, initial movement of the switch contacts toward open position effected manually through operation of the handle 61 and operating lever 55.

As soon as the handle 61 moves the lost motion connection 89 and the drive rod 75 of the overcenter spring mechanism past its center toggle position, the coil spring 77 begins to expand and effects a rapid counterclockwise switch-opening movement of the operating lever 55. Expansion of the spring 77 propels the drive rod 75 to the position shown in FIG. 3. The movement of the drive rod rotates the switch operating lever 55 to the position shown in FIG. 4, which causes complete opening of the switch contacts 19 and 27.

The counterclockwise rotation of the follower plate 93 moves the circular peripheral edge 107 of the follower plate out of contact with the face 171 of the trigger mechanism 165, thereby allowing the spring 175 to rotate the trigger mechanism in a clockwise direction as viewed in FIG. 3. Rotation of the trigger mechanism 165 lifts the screw 155 and thereby rotates shaft 147 and the door hook 145 in an upward direction to the position of the door hook shown in FIG. 4. Thus, when the switch contacts are in their open position, the hook 145 is raised clear of the door latch 151 so that the door can be opened.

We claim:

1. A switch operating mechanism for opening and closing the movable contacts of a load break bolted pressure contact switch, said mechanism including:

a main shaft, a handle attached to said main shaft for rotating said shaft in opposite directions, between switch-open and switch-closed positions, an operating lever rotatably mounted on said shaft and mechanically connected to said movable switch contacts, an overcenter toggle spring means for driving said operating lever to its contact-open and contact-closed positions, a lost motion connection means connecting said main shaft, said operating lever and said overcenter toggle spring means, said lost motion connection generally arranged so that initial rotation of the main shaft compresses the overcenter toggle spring means and moves it towards its center toggle position and specifically arranged so that during movement from said switch-closed position to said switch-open position, said operating lever is rotated before said spring means reaches its center toggle position, while during movement from said switch-open position to said switch-closed position, the spring means is moved past its center toggle position before said operating lever is rotated, said overcenter toggle spring means connected to the lost motion connection means by a pin located in an elongated slot, the elongated slot having a detent projection dividing the slot into two portions, the detent retaining the pin in one portion of the slot until overridden to allow the pin to move to the other portion of the slot, the overriding occurring as the toggle spring reaches its fully compressed condition.

2. The switch operating mechanism of claim 1 in which the switch operating mechanism is located in a housing having an access door and includes interlock means for the housing access door having means to latch the access door closed when the switch contacts are in their closed position and additional means to prevent the movement of the switch contacts to their closed position when the access door is open, the interlock means being actuated through engagement with cam and stop surfaces formed as part of the best lost motion connection means.

3. The switch operating mechanism of claim 2 in which the lost motion connection means includes a plurality of follower plates, with the cam and stop surfaces formed on said follower plates, and one of the follower plates actuating the means to latch the access door closed when the switch contacts are in their closed position and another of the follower plates actuating the means to prevent movement of the switch contacts to their closed position when the access door is open.

4. The switch operating mechanism of claim 3 in which the means to latch the access door closed includes spring means normally biasing a door hook into engagement with a door latch, and resist means to preclude operation of the door biasing means, the cam surface on the follower plate which actuates the means to latch the access door closed being engageable with the resist means at defined rotational positions of the lost motion connection means to override the resist means and allow the door hook biasing means to urge the hook into engagement with the door latch.

5. The switch operating mechanism of claim 4 in which the resist member prevents movement of the door hook toward its latching position but not away from its latching position, and in which means are provided to move the door hook away from its latched position from the exterior of said switch enclosure without opening the switch.

6. The switch operating mechanism of claim 3 in which the means to prevent the movement of the switch contacts to their closed position when the access door is open includes a pivotally mounted elongated stop member having a stop portion normally biased into engagement with a shoulder on said another of the follower plates to prevent rotation of the lost motion connection means, and in which means are provided to overcome such bias and to move the stop portion out of engagement with the follower plate shoulder when the access door is closed.

7. An interlock for a door of an enclosure for a load break pressure contact switch of the type having a spring driven contact opening and contact closing mechanism, which mechanism is actuated by a rotatable shaft turned by an operating handle, the interlock including:

an elongated stop member pivotally mounted at one end for movement between a first position, in which a stop portion thereon engages a shoulder on a plate mounted on the rotatable shaft, and a second position, in which the stop portion is moved out of engagement with the plate shoulder and the stop member is biased toward its first position, a door contact arm pivotally connected at one end to the free end of the stop member and mounted to move the stop member from its first position to its second position upon closing of the enclosure door, a door hook pivotally mounted for movement towards and away from a door latching position, means biasing the door hook toward its door latching position, means adapted to resist the door hook latching biasing means, the resist means being movable between a first position in which the door hook biasing means is effectively defeated to a second position where the biasing means is free to urge the hook to its door latching position, the resist means being movable from its first position to its second position by engagement with a lobe of a plate mounted on the rotatable shaft.

8. The interlock of claim 7 in which the resist means includes a pivotally mounted trigger mechanism operatively engageable with the door hook biasing means upon rotation in the opposite direction, and means biasing the trigger mechanism in the direction of engagement, the trigger mechanism being so positioned relative to the lobe of the plate that engagement of the lobe with the trigger mechanism rotates the trigger mechanism away from the door hook biasing means.

* * * * *